US007284844B2

(12) United States Patent
Seu

(10) Patent No.: US 7,284,844 B2
(45) Date of Patent: Oct. 23, 2007

(54) AIR-DRIVEN DELIVERY ASSEMBLY

(75) Inventor: Preston D. Seu, Vancouver, WA (US)

(73) Assignee: Hewlett-Packard Development Comapny, L.P., Houston, TX (US)

( * ) Notice: Subject to any disclaimer, the term of this patent is extended or adjusted under 35 U.S.C. 154(b) by 313 days.

(21) Appl. No.: 10/909,215

(22) Filed: Jul. 30, 2004

(65) Prior Publication Data

US 2006/0023038 A1 Feb. 2, 2006

(51) Int. Cl.
*B41J 2/175* (2006.01)

(52) U.S. Cl. ..... 347/85

(58) Field of Classification Search ..... 347/84, 347/85, 86, 87; 141/2, 18
See application file for complete search history.

(56) References Cited

U.S. PATENT DOCUMENTS 4,484,827 A 11/1984 Price, Jr.
5,116,650 A * 5/1992 Bowser ..... 428/34.2
5,691,753 A * 11/1997 Hilton ..... 347/85
6,464,346 B2 10/2002 Otis, Jr.
6,543,386 B1 4/2003 Boggs
6,612,689 B2 * 9/2003 Suenaga et al. ..... 347/85
6,637,872 B2 * 10/2003 Ara et al. ..... 347/85
6,722,761 B2 * 4/2004 Asano et al. ..... 347/85
6,726,313 B1 * 4/2004 Oda et al. ..... 347/85
6,783,215 B2 * 8/2004 Yoshida et al. ..... 347/85

* cited by examiner

*Primary Examiner*—Anh T. N. Vo

(57) ABSTRACT

An air-driven delivery assembly for delivering marking material to a print head includes a supply reservoir configured to contain a quantity of marking material, a containment chamber coupled to the supply reservoir, and a low pressure source coupled to the containment chamber wherein activation of the low pressure source draws marking material from the supply reservoir into the containment chamber.

40 Claims, 7 Drawing Sheets

AIR-DRIVEN DELIVERY ASSEMBLY

BACKGROUND

Efforts have been made to reduce the cost and size of ink-jet printers and to reduce the cost per printed page. Some of these efforts have focused on developing printers having small, moving print heads that are connected to larger stationary ink reservoirs by flexible ink tubes. This configuration is commonly referred to as "off-axis" printing.

The development of off-axis printing has created the need to precisely control the pressure of the ink at a variety of locations, including the ink reservoir and the print head. Print cartridges may have an internal pressure regulator for regulating the flow of ink from an external source into an ink chamber within the print cartridge. The internal pressure regulator controls the flow of ink into the print cartridge to maintain a relatively constant back pressure at the print head. A relatively constant back pressure may be necessary to prevent the undesired leakage of ink through the print head. This leakage, or drooling, may degrade the quality of printing produced by the printer and may even cause permanent damage to the printer.

Designs utilizing a separate pressure regulator to address these issues may be relatively complicated. In addition, such pressure regulators often have a low tolerance for ingested air, and hence, require special materials to minimize air transmission. In addition, physical contact between the ink and the parts of the regulator sometimes reduce the operating life of the system, due to the corrosive nature of some inks.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

The present air-driven delivery assembly uses a low pressure source to replenish a small ink tank within a carriage-mounted pen by drawing ink into the pen from an off-axis supply reservoir. The pen contains structure for preventing the ink from being drawn into the low pressure source while allowing the passage of air. This structure allows the pen to be refilled by activating the low pressure source for a predetermined period of time, regardless of the ink level. This allows for a simplified filling and refilling process.

The pen also contains structure for maintaining the ink contained in the pen at relatively low pressure. This low pressure, or back pressure, minimizes the ink that leaks or drools from the print head while the print head is not in use. The air-driven delivery assembly is able to maintain this back pressure over a wide range of temperatures and pressures because, at least in part, the system is opened during periods of non-use.

As used herein and in the appended claims, "on-axis" shall broadly be understood to mean the location of any part, component, or group of components that move with a print head. "Off-axis" shall be broadly understood to mean the location of any part, component, or group of components that do not move with a print head, for example, an off-axis ink reservoir. "Bubble pressure" shall mean the liquid pressure needed to force the liquid through an initially air saturated sample.

As used herein and in the appended claims, a marking material shall be broadly construed as any material suitable for marking a print medium, such as paper. Ink will be used as one example of a suitable marking material, but should not be construed to limit the application of the present system and method to the use of ink. As used herein, a marking material may be, for example, ink, toner, colorant, marking fluid, etc.

In the following description, for purposes of explanation, numerous specific details are set forth in order to provide a thorough understanding of the present method and apparatus. It will be apparent, however, to one skilled in the art, that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1:
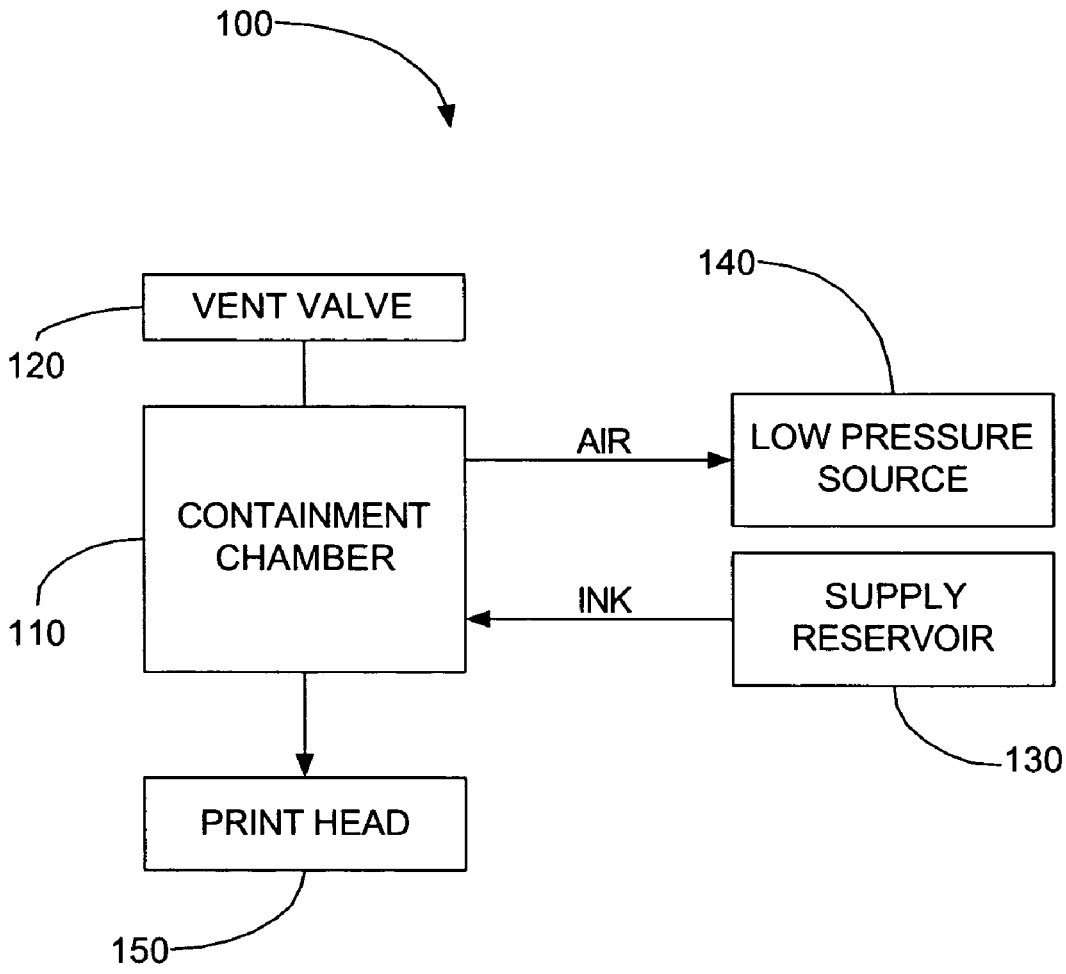
FIG. 1 is a schematic of an air-driven delivery assembly according to one exemplary embodiment.

FIG. 1 is a schematic view of an air-driven delivery assembly (100) for marking material in a printing device. The assembly (100) generally includes an on-axis containment chamber (110) coupled to a vent valve (120), a supply reservoir (130), a low pressure source (140) and a print head (150). As will be discussed in more detail below, the delivery assembly (100) provides for filling and/or refilling of the on-axis containment chamber (110) by controlling the vent valve (120) and the low pressure source (140). This filling may be accomplished without passing substantial amounts of marking fluid, such as ink, through the low pressure source (140). In fact, the low pressure source (140) will typically only pass air.

As described below, the on-axis containment chamber (110) may be refilled by a relatively simple low pressure source (140). This operation may be accomplished without drawing ink through the low pressure source (140), which promotes a longer life for the assembly (100). In addition, the air-driven delivery assembly (100) provides for a reduced amount of ink to be stored on-axis in the containment chamber (110). The ink is directly dispensed from the containment chamber (110) through the print head (150), with the containment chamber (110) being refilled from the off-axis reservoir (130). In addition, the reduced size of the on-axis marking material supply in the containment chamber (110) allows for a smaller overall printing device. The use of an off-axis supply reservoir (130) allows for increased supply reservoir volume, which decreases operating expense by reducing the frequency of refilling or replacing the ink supply.

During printing operations, the containment chamber (110) is coupled to atmosphere, such as by opening the vent valve (120), while the low pressure source (140) is turned off. Further, the supply reservoir (130) may be continuously open to the atmosphere, such that ink may be drawn from the supply reservoir (130) without substantially increasing the pressure therein. During printing operations the ink containment chamber (110) acts as an on-axis ink supply.

The print head (150) selectively dispenses material in response to delivery commands, based on a print job. The print job provides motion and dispensing commands that are then used by a printing system to selectively deposit marking material on a print medium to form the desired text or image. The print head (150) described herein may be any marking material dispenser capable of selectively depositing marking material. The print head (150) may be, for example, an inkjet print head capable of performing print on-demand applications including, but in no way limited to, thermally activated inkjet material dispensers, mechanically activated inkjet material dispensers, electrically activated inkjet material dispensers, magnetically activated material dispensers, and/or piezoelectrically activated material dispensers.

As the print head (150) operates, the amount of ink remaining in the containment chamber (110) decreases. When the amount of ink decreases below a pre-determined level, or when printing operations are stopped, the containment chamber (110) may be refilled. To refill the containment chamber (110), the containment chamber (110) is decoupled from the atmosphere, such as by closing the vent valve (120). The containment chamber (110) remains connected to the supply reservoir (130) and the low pressure source (140).

Activating the low pressure source (140) initially places the low pressure source (140) at a lower pressure than the containment chamber (110). As a result, air is drawn to the low pressure source (140) from the containment chamber (120). As the air is withdrawn from the containment chamber (110), the containment chamber is placed at a lower pressure than the supply reservoir (130). This pressure differential causes ink to flow from the supply reservoir (130) to the containment chamber (110), thereby refilling the containment chamber (110). As a result, while printing operations are paused, the containment chamber (110) is refilled by the supply reservoir (130), which is off-axis.

As will be discussed in more detail below, in some exemplary embodiments the containment chamber (110) includes structure that allows air to be withdrawn from the containment chamber (110) and that simultaneously prevents ink from being drawn into the low pressure source (140). As a result, the air-driven delivery assembly (100) is configured to use a low pressure source (140) to refill a containment chamber (110), while minimizing the amount of ink that passes through the low pressure source (140).

Exemplary Implementation and Operation

Figure 2:
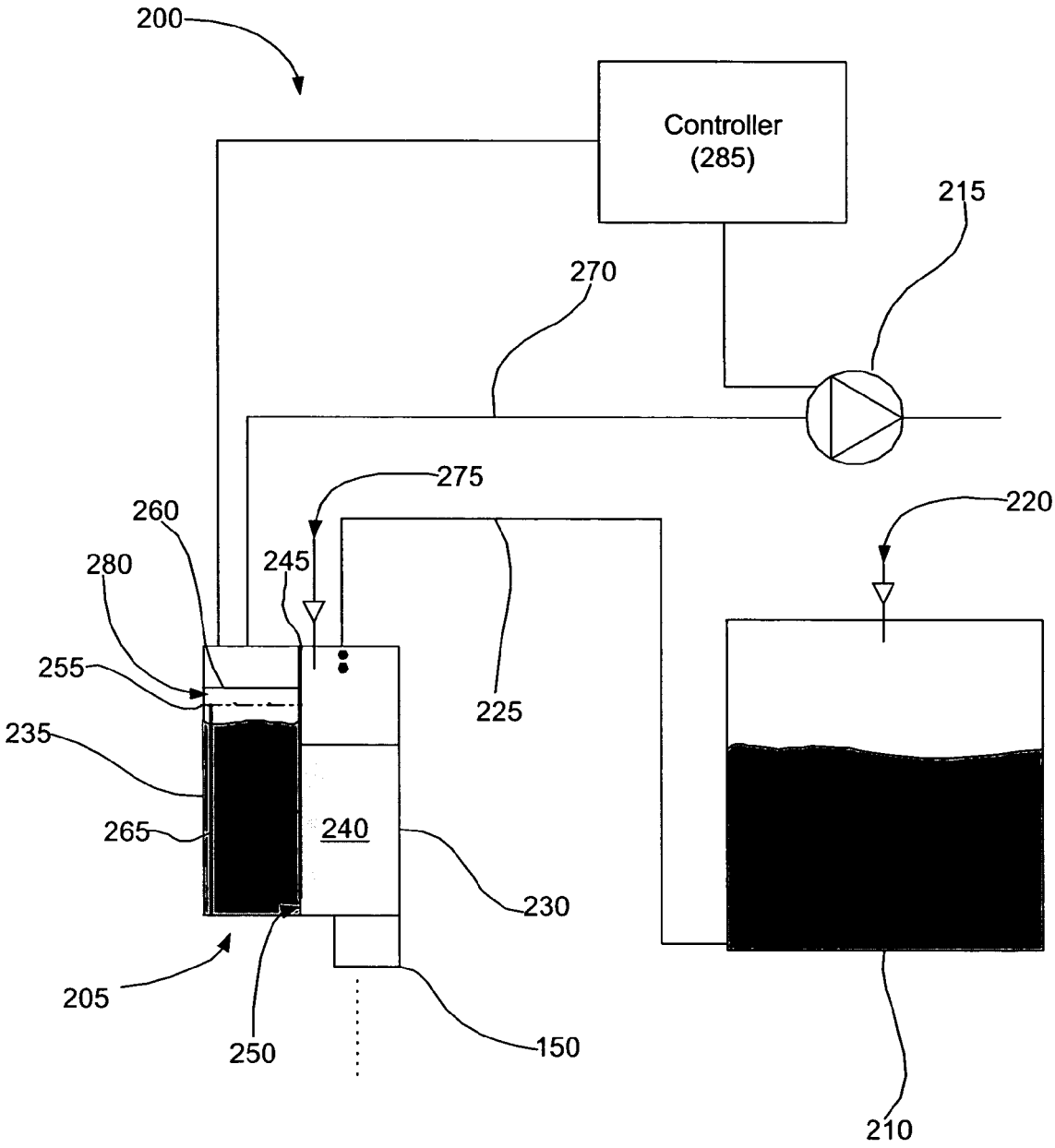
FIG. 2 is a schematic of an air-driven delivery assembly according to one exemplary embodiment.

FIG. 2 illustrates an air-driven marking material delivery assembly (200) that generally includes a pen (205) coupled to an ink supply reservoir (210) and a low pressure source such as a pump (215). In a similar fashion as described above with reference to FIG. 1, the pen (205) may be filled and/or refilled at least in part by controlling the pump (215). The pump (215) pumps air and not marking material. The specific configuration of the exemplary material delivery assembly (200) shown in FIG. 2 will now be discussed in more detail.

The supply reservoir (210) includes a vent (220) that couples the supply reservoir (210) to the atmosphere. Therefore, the ink contained within the supply reservoir (210) is substantially at atmospheric pressure. A supply tube (225) couples the supply reservoir (210) and the pen (205).

In the illustrated embodiment, the supply tube (225) is coupled to the supply reservoir (210) such that the inlet of the supply tube (225) is near the bottom of the supply reservoir (210). Placement of the inlet of the supply tube (225) near the bottom of the supply reservoir (210) maximizes the amount of ink that can be withdrawn from the supply reservoir (210) while ensuring that ink contained in the supply reservoir (210) is available to the pen (205).

The pen (205) includes a first chamber (230) that is coupled to a print head (150) and a second chamber (235). In the illustrated embodiment, the supply tube (225) extends from near the bottom of the supply reservoir (210) to near the top of the first chamber (230).

The first chamber (230) has a porous medium (240) contained substantially therein. The porous medium (240) may be a hydrophilic material such as polyurethane foam or glass beads. As a result, when ink is contained within the porous medium, pressure may be required to draw the ink from the porous medium into the print head (150). The pressure required to draw ink from the porous medium into the print head (150) may be generally described as a first or foam back pressure. This back pressure may be equivalent to a pressure of approximately two inches of water column.

The first and second chambers (230, 235) are at least partially separated by a barrier (245). A gap (250) is formed near the bottom of the barrier (245) to place the first and second chambers (230, 235) in fluid communication with one another.

As shown in FIG. 2, the second chamber (235) includes a wetting screen (255) and a hydrophobic membrane (260). The wetting screen (255) is a screen that is wetted by the ink used by the pen (205). The wetting of the wetting screen (255) with ink generates a second back pressure with respect to the porous medium (240). The second back pressure may be larger than the first back pressure described above, and may be a pressure equivalent to approximately four inches of water column. Accordingly, the second back pressure prevents ink from saturating the porous medium (240), while the first back pressure prevents ink from drooling from the print head (150).

If the second chamber (235) did not include the second back pressure created by the wetting screen (255), ink contained in the second chamber (235) would possibly flow through the gap (250) and into the porous medium (240). For example, this flow may be due to leakage of air from the pump (215). If this ink flow remained unchecked, ink would flow into the porous medium (240) until the porous medium (240) became saturated. If the porous medium (240) was allowed to become saturated, the first back pressure established above might be lost. This loss of back pressure, in turn, might cause the pen (205) to drool or leak ink.

A wick (265) may be used to ensure contact between the wetting screen (255) and the ink contained in the second chamber (235). The wick (265) extends from the wetting screen (255) into the ink contained within the second chamber (235). The wick (265) fluidly couples the wetting screen (255) to the ink.

Ink is drawn into the second chamber (235) by establishing negative pressure therein, in a similar manner as discussed above with reference to FIG. 1. As seen in FIG. 2, to draw ink into the second chamber (235), a vent (275) in the first chamber (230) is closed and the pump (215) is activated. The pump (215) may be any low pressure source configured to provide low pressure. Examples of low pressure sources include, for example, small air pumps used in air sampling and medical instruments. These pumps may include reciprocating piston pumps with rubber flapper valves to control flow.

Closing the vent (275) causes pressure changes in the second chamber (235) to affect pressure in the first chamber (230). The pump (215) then pumps air from the second chamber (235) of the pen (205) though a low-pressure line (270). This reduces the pressure in the second chamber (235) and in the first chamber (230).

Consequently, due to the operation of the pump (215), the lowered pressure in the first chamber (230) causes ink to flow from the supply reservoir (210) to the first chamber (230). The continuing operation of the pump (215) causes the ink to continue to flow from the first chamber (230) into the second chamber (235) and to the wetting screen (255). The hydrophobic membrane (260) then resists the further flow of ink. In some cases, the ink may have a surface tension lower than water. Thus, the membrane (260) would need a lower surface energy that is required to be hydrophobic. In such case, the membrane (260) is oleophobic. In one embodiment, the membrane used is Gore 2432233150-0.

The hydrophobic membrane (260) may have a relatively high bubble pressure. The bubble pressure refers to the pressure differential required to draw or force liquid from one side of a membrane to the other. The hydrophobic membrane (260) may have a bubble pressure equivalent to about forty inches of water column. This bubble pressure is substantially larger than the operating pressure of the pump, such that during normal operation, the pump (215) does not draw ink through the hydrophobic membrane (260). In addition, the surface energy of the hydrophobic membrane (260) is lower than the surface energy of the ink. Consequently, the hydrophobic membrane (260) allows air and vapor to pass while preventing ink from passing through at pressures equivalent to less than about forty inches of water column. The pump (215) operates at a pressure substantially lower than forty inches of water column. As a result, the hydrophobic membrane allows air to pass through at the operating pressures of the pump (215), while preventing ink from passing. Accordingly, the pump (215) draws ink into the second chamber (235) without drawing ink through the pump (215). When the level of ink in the second chamber (235) reaches the hydrophobic membrane (260), the pen (205) is refilled and the pump (215) can be turned off. The pump (215) is controlled by a controller (285). The controller (285) can run the pump (215) for a predetermined period of time when the refill operation is initiated. This time period is made sufficient to refill the pen (205). Alternatively, the controller (285) can monitor the pressure or ink level in the pen (205) and control the pump (215) in response to a detected pressure or ink level in the pen (205). The controller (285) may include a mechanical regulator or a sensor that determines when to activate the pump (215) based on ink level or pressure in the pen (205). The controller (285) can also control the vents (275, 200) in coordination with the pump (215). The filling process will be discussed in more detail below with reference to FIG. 4.

Once the fill or refill operation is complete, the vent (275) is opened and the pump (215) is deactivated. If the pump (215) does not maintain an air tight seal, air may leak from the pump (215), through the low pressure line (270), and into the second chamber (235). As discussed, if unchecked, air leakage from the low pressure source (270) through the low pressure line (270) may cause the ink within the second chamber (235) to drain into the porous medium (240), thereby saturating the porous medium (240). The wetting screen (255) counters the flow of the ink from the second chamber (235) to the first chamber (230) by establishing a second back pressure, as previously discussed. Accordingly, the second back pressure created by the wetting screen (255) minimizes the effects of air leakage through the low pressure line (270).

During printing, ink is dispensed from the pen (205) though the print head (150) connected to the first chamber (230). As ink is removed from the porous medium (240) in the first chamber (230), the ink saturation level lowers. This allows air to pass through the porous medium (240) and through the gap (250) between the chambers (230, 235). The entering air displaces the ink in the second chamber (235) which ink is then absorbed by the porous medium (240). This continues until the higher ink saturation level in the porous medium (240) causes the air to stop flowing. In this way, ink from the second chamber (235) is moved to the first chamber (230) for use in printing operations.

As shown in FIG. 2, there is space (280) between the wetting screen (255) and the hydrophobic membrane (260). The space (280) may have a volume of about 0.25 cc. As previously discussed, air is drawn from second chamber (235) through the pump (215) during a refill operation. During this process, the wetting screen (255) will form bubbles. The volume of the space (280) allows ink bubbles to burst without forming an ink film that covers the hydrophobic membrane (260) and stops air flow. In some instances, ink may remain between the wetting screen (255) and the hydrophobic membrane (260).

Figure 3:
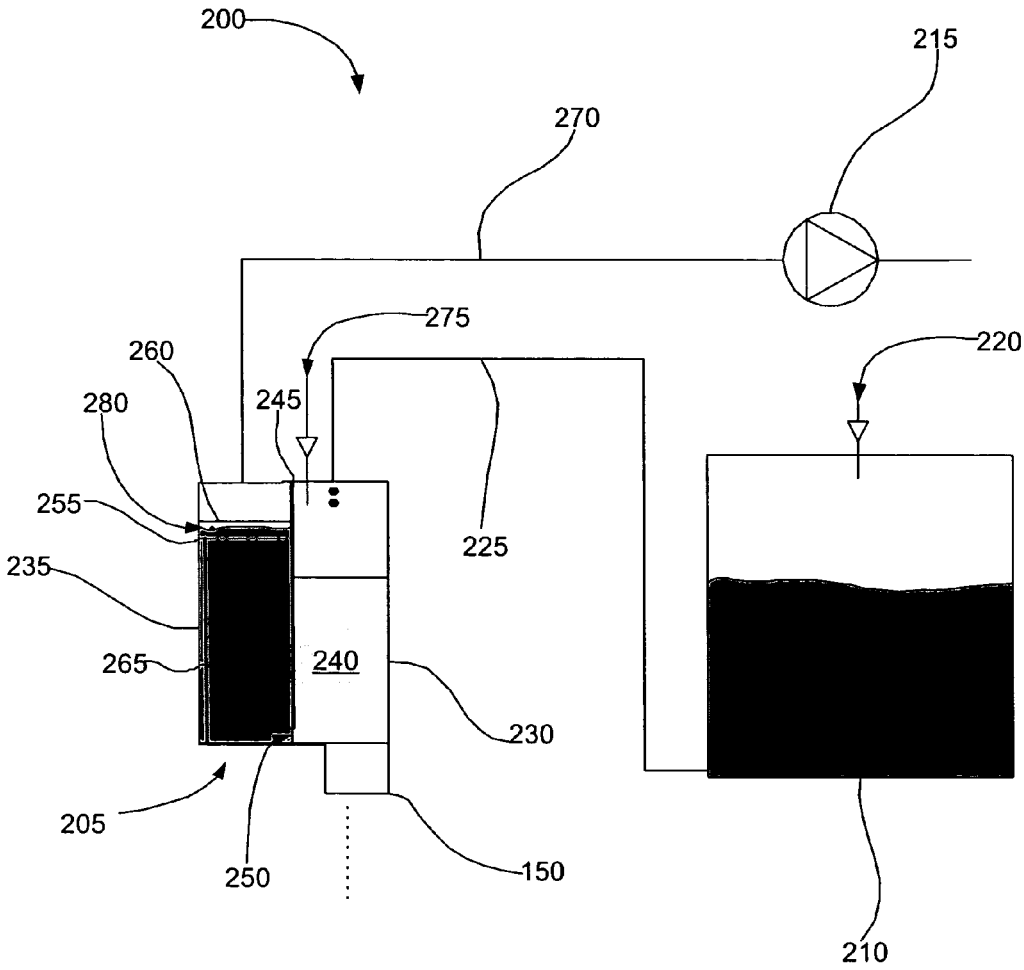
FIG. 3 is a schematic of the air-driven delivery assembly shown in FIG. 2 wherein ink is contained between a wetting screen and a hydrophobic membrane according to one exemplary embodiment.

This situation is shown in FIG. 3. As previously discussed, air leakage from the pump (215) and/or the low pressure line (270) may allow the ink between the screens (255, 260) to drain. This leakage is countered, at least in part, by the wetting screen (255). A sufficient volume of porous medium (240) may be used to accept this ink and hold the ink at a negative pressure with respect to the print head (150). Accordingly, the second back pressure prevents ink from saturating the porous medium (240), while the first back pressure prevents ink from drooling from the print head (150).

Accordingly, the present marking material delivery assembly (200) allows for a simplified on-axis supply to a print head (150) during printing operations, while allowing a simplified refill of the pen (205) to be accomplished by an off-axis supply reservoir (210). Further, the refill is accomplished with a reduced part count and without pumping ink through the low pressure source.

Figure 4:
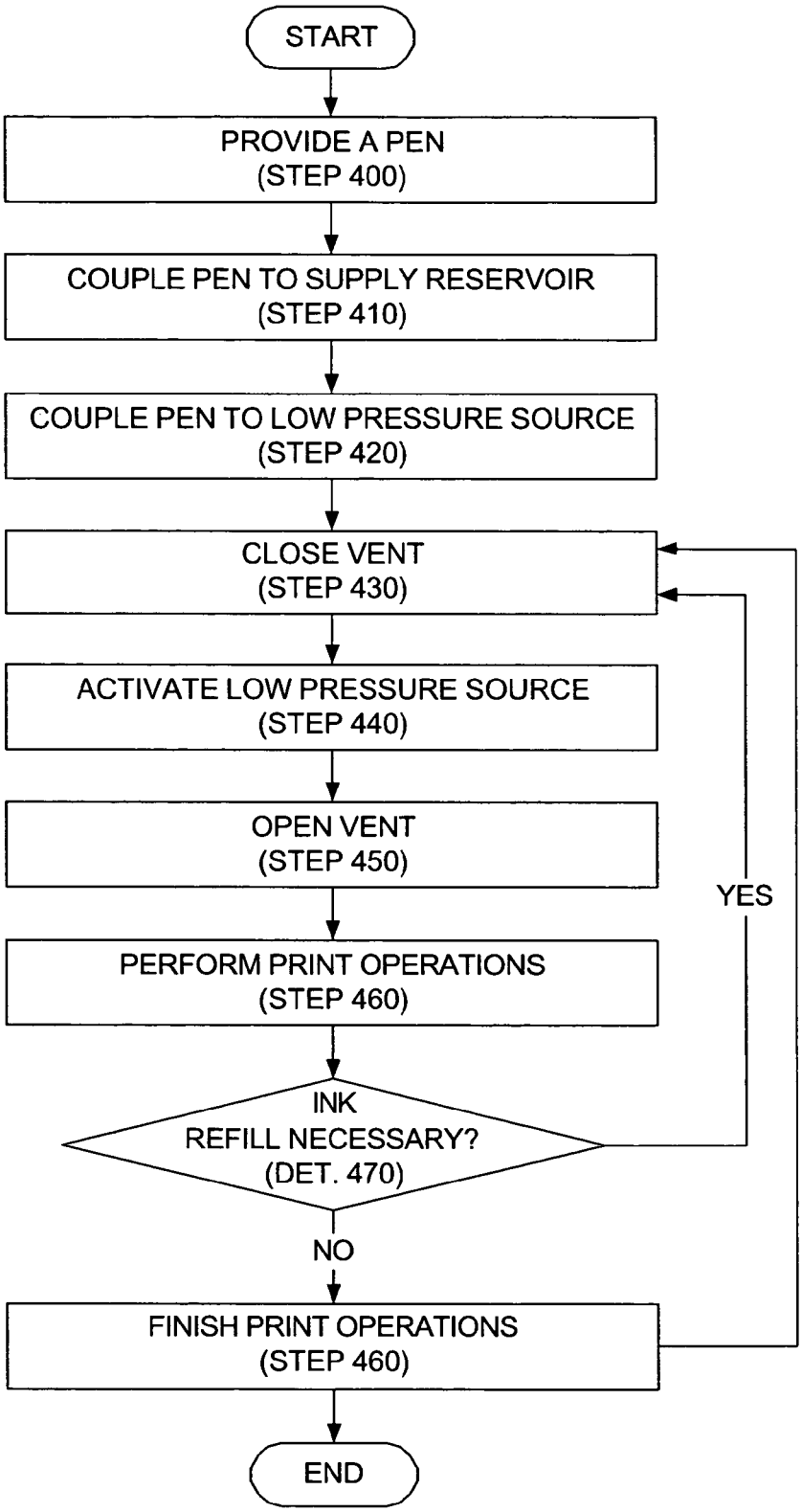
FIG. 4 is a flowchart illustrating a method of providing ink to a print head according to one exemplary embodiment.

FIG. 4 is a flowchart illustrating a method of providing ink to a print head. The method begins by providing a pen (step 400). The pen includes a containment chamber and a print head. The containment chamber is coupled to the print head and includes structure for maintaining the ink contained therein at a negative pressure with respect to the print head.

The pen is then coupled to a supply reservoir (step 410) and to a low pressure source (step 420). The supply reservoir and the low pressure source is coupled to the pen in such a manner that removal of air contained in the pen causes ink to flow from the supply reservoir to the pen. Further, the pen includes structure that allows air to be withdrawn, but substantially prevents the withdrawal of ink. The pen also includes a vent that allows the pen to be selectively opened and closed with respect to atmospheric pressure.

Steps 430-450 describe the filling or refilling operation of the pen. To fill the pen, the vent is closed (step 430) such that the pen is not substantially open to the atmosphere. Once the vent has been closed (step 430), the pressure in the pen is dependent, at least in part, on the pressures of the low pressure source and the supply reservoir.

Once the vent has been closed, the low pressure source is activated for a predetermined period of time (step 440) or until a desired pressure or ink level is detected. Activating the low pressure source causes ink to flow from the supply reservoir to the pen. More specifically, the low pressure source draws air from the pen through the wetting structure and a hydrophobic membrane contained within the pen. The hydrophobic membrane permits air to pass, but restricts the movement of ink. As the air is evacuated, the pressure in the pen falls.

As previously discussed, the pen is also coupled to the supply reservoir. The relative pressure in the pen is lower than the relative pressure in the supply reservoir. As a result, ink flows from the supply reservoir to the pen. As the ink flows to the pen, the level of ink contained within the pen rises until the ink level rises to, first, the level of the wetting structure and, subsequently, to the level of the hydrophobic membrane. As ink is further drawn through the wetting structure, the ink level is prevented from rising substantially above the level of the hydrophobic membrane. As previously discussed, this may be due in part to the nature of the membrane, which allows gas or air to pass to the low pressure source while minimizing the amount of ink that passes to the low pressure source.

As a result, if the low pressure source continues to operate after the ink level has reached the hydrophobic membrane, the ink level will not substantially rise beyond the hydrophobic membrane. Consequently, refilling a pen according to the present method may be done by activating the low pressure source for a pre-determined period of time, regardless of the level of the ink contained within the pen. The use of a single time period for refilling simplifies a filling or refilling process, in that a calculation of the time required to fill the pen may be omitted.

Once the pen has been filled or refilled for the predetermined period of time (step 440), the pump is deactivated and the vent is opened (step 450). Printing operations are then performed (step 460). During normal print operations, drop-counter processes may determine whether print operations should be paused while the pen is refilled (determination 470). The pen may be sized such that the pen has sufficient ink to perform most print jobs. If a mid-operation refill is not necessary (NO, step 470), the printing operation is completed (step 480). Once printing operations have stopped, the refilling procedure (steps 430-450) may be restarted, such that the pen will be at maximum capacity when print operations begin again (step 460).

As a result, the present method allows an on-axis containment chamber to be refilled by a relatively simple low pressure source. This operation may be accomplished without drawing ink through the low pressure source, which provides for longer life of the assembly. In addition, the air-driven delivery assembly (200) provides for a reduced amount of ink to be stored on-axis in the pen (205), thereby allowing the marking material to be directly dispensed, while allowing the pen (205) to be refilled using an off-axis reservoir. In addition, the reduced size of the on-axis supply allows for a smaller overall printing device. The use of an off-axis supply reservoir allows for increased supply reservoir volume, which decreases operating expense by reducing the frequency of refilling or replacing the ink supply.

Figure 5:
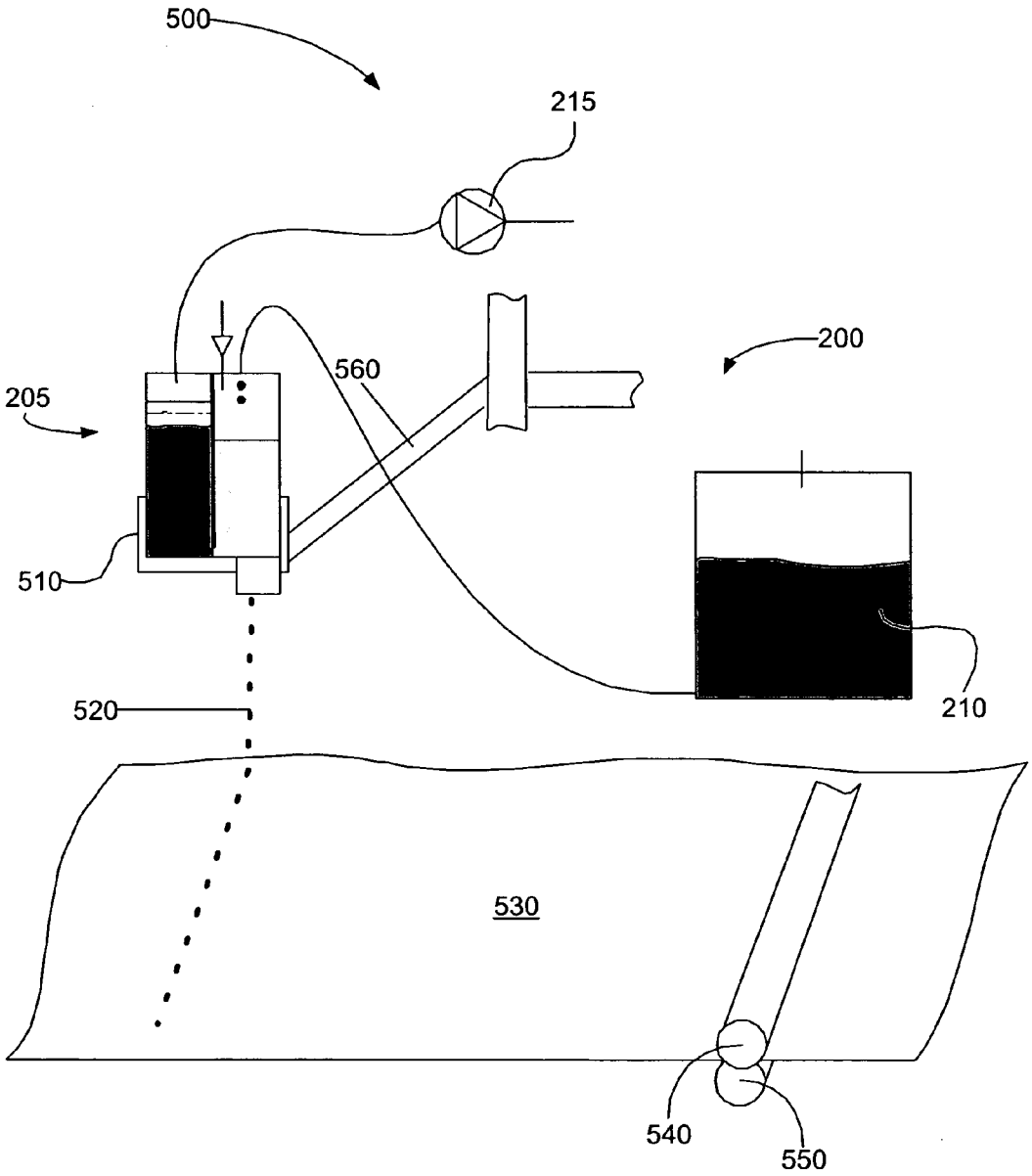
FIG. 5 is a schematic of a printing device according to one exemplary embodiment.

FIG. 5 is a schematic of a printing device (500) that includes an air-driven delivery assembly (200). The pen (205) is coupled to a carriage (510) in an on-axis configuration. The pen (205) may be replaceably coupled to the carriage (510), such that the pen (205) alone may be replaced when the pen (205) has surpassed its useful life.

The pen (205) includes both a print head and a refillable ink supply. In such an embodiment, the air-driven delivery assembly (200) provides ink for the print head (150). The print head (150) selectively ejects drops of ink (520) onto a print medium (530), according to print job data, to form desired text and/or images on the print medium (530). The print medium (530) is moved laterally with respect to the print head (150) by a media advancement system that may include, for example, two driven rollers (540, 550). The carriage (510), and hence the print head (150), are moved back and forth across the print medium (530) by a carriage control mechanism that may include, for example, a drive belt (560) or other device.

The print head (150) contains a plurality of firing chambers that are energized on command by selectively firing resistors. Thus, as the print head moves laterally across the print medium (530) and the print medium (530) is moved by the rollers (540, 550), drops of ejected ink (520) form images and/or text on the print medium (530).

The supply reservoir (210) and the pump (215) are located off-axis. By positioning these components off-axis, the size of the printing device (500) may be decreased. Further, the weight carried by the carriage (510) may be minimized, thereby reducing the power required to move the carriage and the precision with which the carriage (510) may be controlled.

Alternative Embodiments

Figure 6:
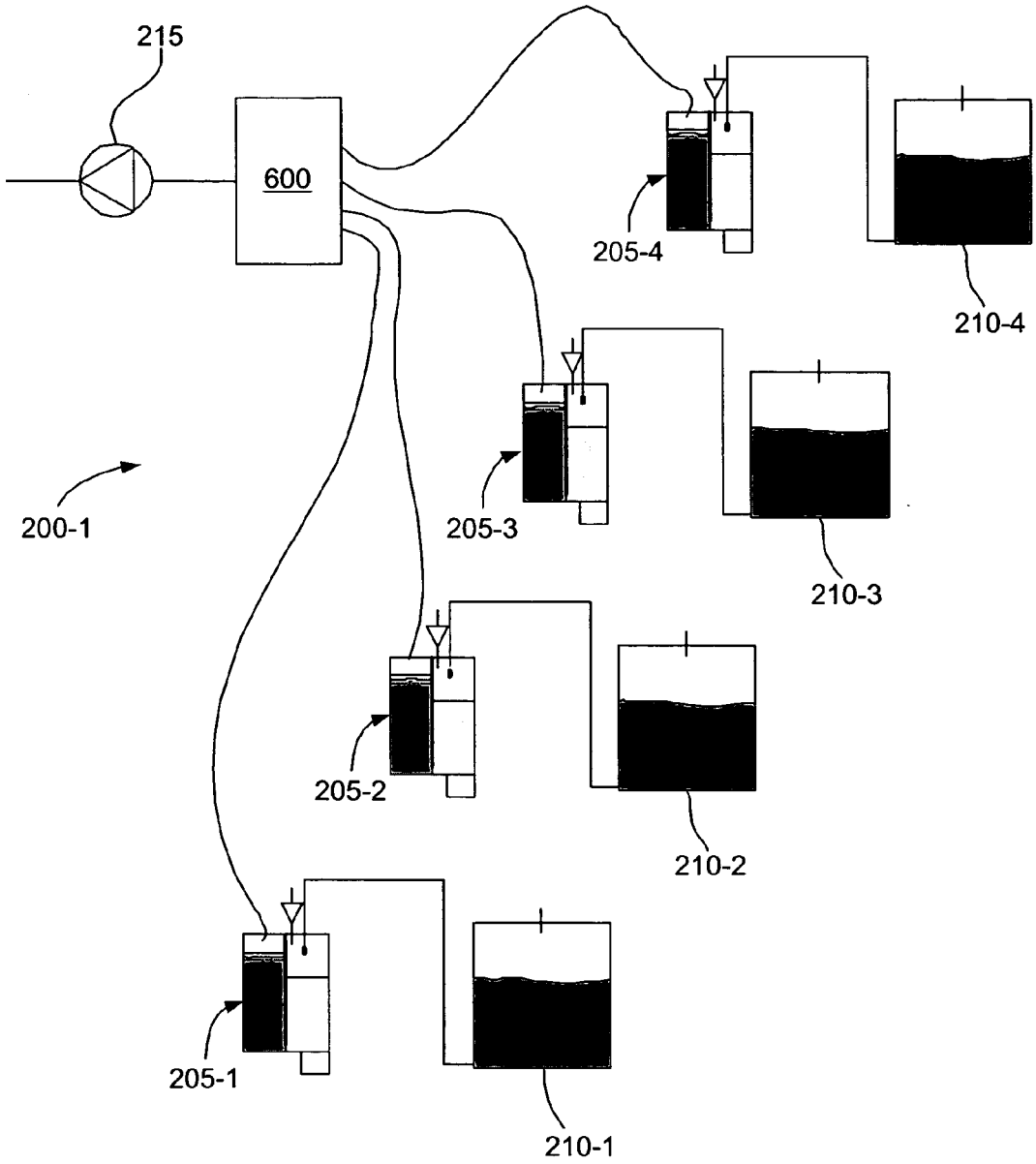
FIG. 6 is a schematic of an air-driven delivery assembly having a plurality of pens driven by a single pump according to one exemplary embodiment.

The air-driven delivery assembly (200) discussed with reference to FIG. 2 included a single pen (205). As shown in FIG. 6, an air-driven delivery assembly (200-1) may include multiple pens (205-1, 205-2, 205-3, 205-4). Each of the pens may in turn be coupled to a corresponding supply reservoir (210-1, 210-2, 210-3, 2104). The pens and supply reservoirs may correspond to any of a number of different color schemes, for example, a cyan, magenta, yellow, and black (CYMK) color scheme. Alternatively, the supply reservoirs may correspond to a red, green, blue, and black (RGBK) color scheme. The assembly (200-1) also includes a manifold (600). The manifold (600) couples each of the pens (205-1, 205-2, 205-3, 205-4) to a single pump (215). The single pump (215) may be activated for a predetermined period of time as discussed with reference to FIG. 4 to fill each of the pens (205-1, 205-2, 205-3, 205-4). Accordingly, the part count of a multi-pen assembly (200-1) may be reduced by incorporating a manifold to couple the pens (205-1, 205-2, 205-3, 205-4) to a single pump (215).

Figure 7:
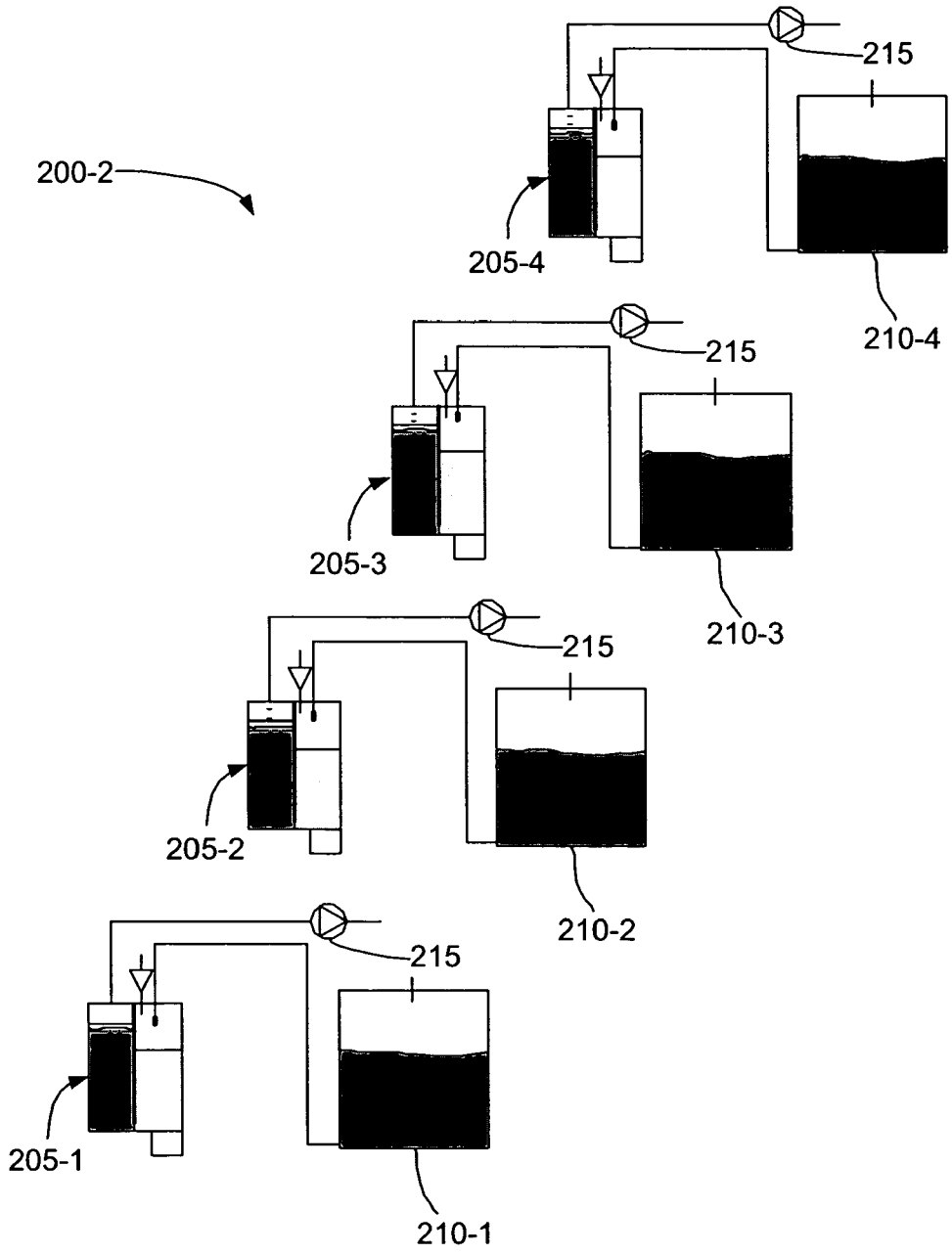
FIG. 7 is a schematic of an air-driven delivery assembly having a plurality of pens each driven by a corresponding pump according to one exemplary embodiment.
Figure 4:
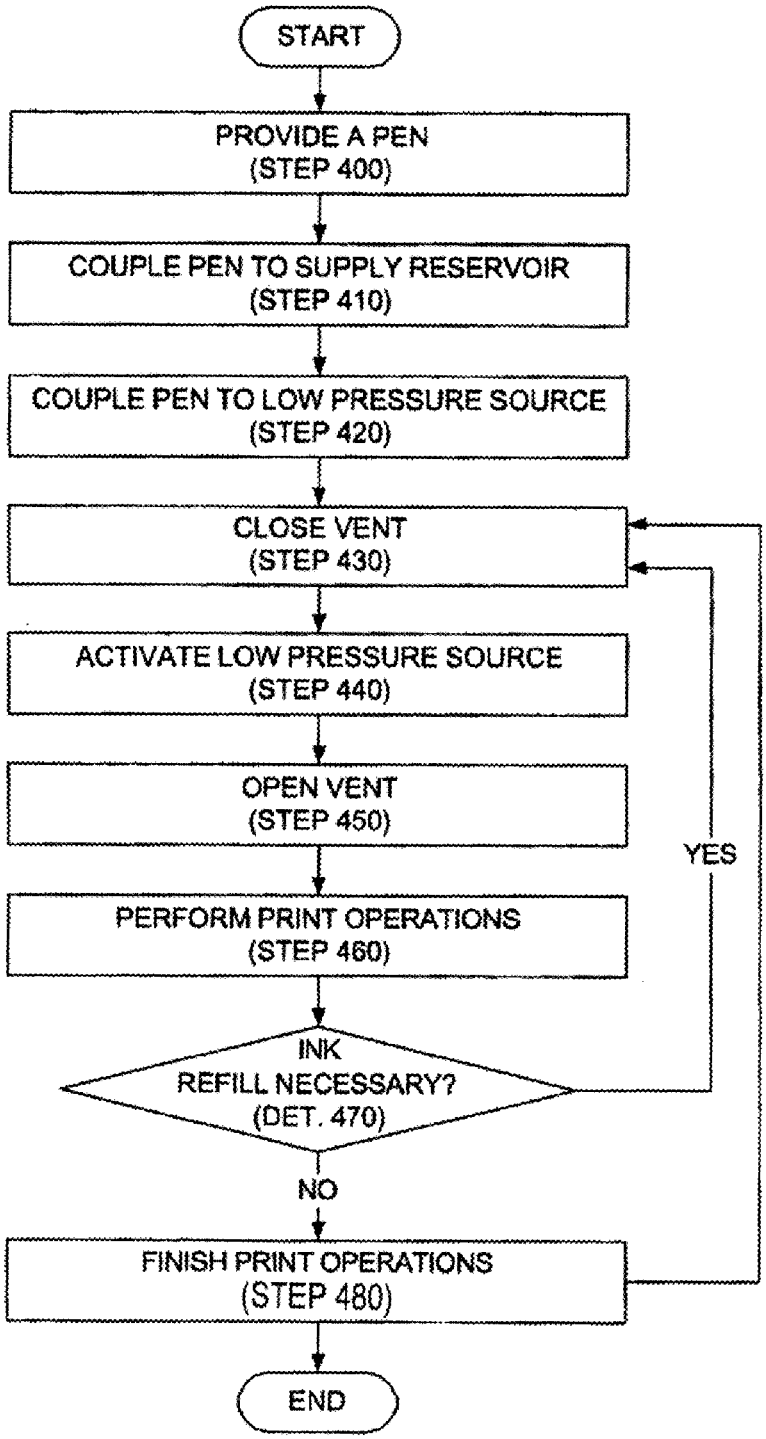

As shown in FIG. 7, an air-driven delivery assembly (200-2) includes a plurality of pens (205-1, 205-2, 205-3, 205-4) coupled to corresponding supply reservoirs (210-1, 210-2, 210-3, 210-4). The pens (200-1, 200-2, 200-3, 200-4) are in turn coupled to corresponding low pressure sources (270). Further, any number of pens may be coupled to any number of low pressure sources. Those of skill in the art will appreciate that any number of variations of air-driven assemblies may be used in printing devices, such as the printing device (500) discussed with reference to FIG. 5.

In conclusion, the air-driven delivery assemblies allow for an on-axis containment chamber to be refilled by a relatively simple low pressure source. This operation may be accomplished without drawing ink through a low pressure source, which provides for longer life of a given assembly. In addition, the air-driven delivery assemblies provide for a reduced amount of ink to be stored on-axis in the containment chamber, thereby allowing the marking material to be directly dispensed, while allowing the containment chamber to be refilled using an off-axis reservoir. In addition, the reduced size of an on-axis supply allows for a smaller printing device. The use of an off-axis supply reservoir allows for increased supply reservoir volume, which decreases operating expense by reducing the frequency of refilling or replacing the ink supply.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the invention be defined by the following claims.

What is claimed is:

1. An air-driven delivery assembly for delivering marking material to a print head, the assembly comprising:

a supply reservoir configured to contain a quantity of marking material;

a containment chamber coupled to said supply reservoir; and a low pressure source coupled to said containment chamber wherein activation of said low pressure source draws marking material from said supply reservoir into said containment chamber;

wherein said containment chamber comprises a first chamber coupled to said supply reservoir and having a porous medium disposed therein, and a second chamber coupled to said first chamber and to said low pressure source and being configured to contain a quantity of marking material.

2. The assembly of claim 1, wherein said marking material is drawn into said containment chamber in response to removal of air from said containment chamber by said low pressure source.

3. The assembly of claim 1, wherein said marking material comprises ink.

4. The assembly of claim 1, wherein said second chamber comprises a wetting screen and a hydrophobic membrane that generate negative pressure in said second chamber.

5. The assembly of claim 4, wherein said hydrophobic membrane limits a level of ink in said containment chamber.

6. The assembly of claim 4, wherein said hydrophobic membrane is an oleophobic membrane.

7. The assembly of claim 4, further comprising a wick extending front said wetting screen into said containment chamber.

8. The assembly of claim 1, wherein said porous medium comprises hydrophilic foam.

9. The assembly of claim 1, wherein said porous medium comprises glass beads.

10. The assembly of claim 1, further comprising a wetting screen and hydrophobic membrane contained substantially within said second chamber.

11. The assembly of claim 1, further comprising a vent coupled to said containment chamber to selectively open said containment chamber to atmosphere.

12. The assembly of claim 1, further comprising a controller for selectively operating said low pressure source.

13. The assembly of claim 12, wherein said controller operates said low pressure source for a predetermined period of time.

14. The assembly of claim 12, wherein said controller monitors conditions in said containment chamber and operates said lower pressure source in response to conditions in said containment chamber.

15. The assembly of claim 12, wherein said controller further controls a vent coupled to said containment chamber for selectively opening said containment chamber to atmospheric pressure.

16. An ink delivery assembly comprising:

at least one supply reservoir;

at least one pen including a print head;

a first chamber coupled to said supply reservoir and to said print head and having a porous material contained substantially therein, and a second chamber having a wetting screen and a hydrophobic membrane contained therein; and a low pressure source coupled to said second chamber.

17. The assembly of claim 16, wherein said hydrophobic membrane is between said wetting screen and said low pressure source.

18. The assembly of claim 16, wherein said print head comprises an ink jet print head.

19. The assembly of claim 16, wherein said second chamber includes a proximal end and a distal end, wherein said proximal end is nearest said print head, and further comprising a wick coupled to said wetting screen and extending away from said wetting screen toward said proximal end.

20. The assembly of claim 16, further comprising a plurality of pens and a corresponding plurality of supply reservoirs.

21. The assembly of claim 20, further comprising a manifold, wherein each of said pens is coupled to said manifold and said manifold is coupled to said low pressure source.

22. The assembly of claim 20, wherein each of said plurality of pens is coupled to a corresponding low pressure source.

23. A printing device comprising:

a media advancement mechanism;

a carriage driving mechanism;

a carriage coupled to said carriage driving mechanism; and an air-driven ink delivery assembly having at least one on-axis pen coupled to said carriage, said pen including a print head, a first chamber coupled to said supply reservoir and to said print bead and having a porous material therein, a second chamber having a wetting screen and a hydrophobic membrane contained therein, and a low pressure source coupled to said second chamber.

24. The printing device of claim 23, wherein said supply reservoir is located off-axis.

25. The printing device of claim 23, wherein said low pressure source is located off-axis.

26. The printing device of claim 23, wherein said air-driven ink assembly has a plurality of on-axis pens and a plurality of corresponding off-axis supply reservoirs.

27. The printing device of claim 26, and further comprising a manifold coupled to each of said pens and to a single low pressure source.

28. The printing device of claim 26, wherein said plurality of supply reservoirs corresponds to a red, green, blue, and black color scheme.

29. The printing device of claim 26, wherein said plurality of supply reservoirs corresponds to a cyan, yellow, magenta, and black color scheme.

30. The printing device of claim 23, wherein said printing device is an inkjet printing device.

31. A method of delivering ink to an on-axis containment chamber coupled to a supply reservoir, wherein said containment chamber is divided into first and second chambers that are fluidly coupled to each other, said first chamber containing a porous medium that absorbs marking material in said first chamber, the method comprising:

activating a low pressure source coupled to said containment chamber to draw marking material contained in said supply reservoir into said containment chamber; and holding said marking material in said second chamber under a negative pressure to prevent saturation of said porous medium.

32. The method of claim 31, wherein said low pressure source draws air from said containment chamber to lower a pressure of said containment chamber.

33. The method of claim 31, wherein said low pressure source is activated for a pre-determined period of time.

34. The method of claim 31, wherein sad low pressure source is activated based on a monitored condition in said containment chamber.

35. The method of claim 31, further comprising providing producing said negative pressure with a wetting screen and hydrophobic membrane disposed in said second chamber.

36. The method of claim 35, further comprising wetting said wetting screen with marking material disposed in said second chamber using a wick extending from said wetting screen into said marking material disposed in said second chamber.

37. A system of delivering ink to an on-axis containment chamber coupled to a supply reservoir, wherein said containment chamber is divided into first and second chambers that are fluidly coupled to each other, said first chamber containing a porous medium that absorbs marking material in said first chamber, the system comprising:

means for lowering a pressure in said containment chamber to cause ink to flow from said supply reservoir to said containment chamber;

means for controlling said means for lowering a pressure in said containment chamber; and means for holding said marking material in said second chamber under a negative pressure to prevent saturation of said porous medium.

38. The system of claim 37, further comprising means for selectively venting said containment chamber to atmospheric pressure.

39. The system of claim 38, wherein said means for controlling also controls said means for selectively venting said containment chamber.

40. The system of claim 37, further comprising means for limiting a level of ink drawn into said containment chamber from said supply reservoir.

* * * * *

UNITED STATES PATENT AND TRADEMARK OFFICE

CERTIFICATE OF CORRECTION

PATENT NO. : 7,284,844 B2
APPLICATION NO. : 10/909215
DATED : October 23, 2007
INVENTOR(S) : Preston D. Seu It is certified that error appears in the above-identified patent and that said Letters Patent is hereby corrected as shown below:

On the title page, in field (73), under "Assignee", in column 1, line 2, delete "Comapny" and insert -- Company --, therefor.

On sheet 4 of 7, in Fig. 4, above Box "END", line 2, delete "460" and insert -- 480 --, therefor. As shown in the attached page.

In column 8, line 46, delete "2104" and insert -- 210-4 --, therefor.

In column 9, line 56, in Claim 7, delete "front" and insert -- from --, therefor.

In column 10, line 53, in Claim 23, delete "bead" and insert -- head --, therefor.

In column 11, line 27, in Claim 34, delete "sad" and insert -- said --, therefor.

Signed and Sealed this

Fifth Day of August, 2008

JON W. DUDAS
*Director of the United States Patent and Trademark Office*